US011453922B2

(12) United States Patent
Ryu et al.

(10) Patent No.: US 11,453,922 B2
(45) Date of Patent: Sep. 27, 2022

(54) ULTRA-HIGH-STRENGTH STEEL SHEET HAVING EXCELLENT HOLE EXPANDABILITY AND YIELD RATIO, AND METHOD OF MANUFACTURING THE SAME

(71) Applicant: POSCO, Pohang-si (KR)

(72) Inventors: Joo-Hyun Ryu, Gwangyang-si (KR); Kyoo-Young Lee, Gwangyang-si (KR); Sea-Woong Lee, Gwangyang-si (KR); Won-Hwi Lee, Gwangyang-si (KR)

(73) Assignee: POSCO, Gyeongsangbuk-Do (KR)

( * ) Notice: Subject to any disclaimer, the term of this patent is extended or adjusted under 35 U.S.C. 154(b) by 353 days.

(21) Appl. No.: 16/333,778

(22) PCT Filed: Oct. 24, 2017

(86) PCT No.: PCT/KR2017/011765
§ 371 (c)(1),
(2) Date: Mar. 15, 2019

(87) PCT Pub. No.: WO2018/080133
PCT Pub. Date: May 3, 2018

(65) Prior Publication Data

US 2019/0233910 A1 Aug. 1, 2019

(30) Foreign Application Priority Data

Oct. 24, 2016 (KR) ..... 10-2016-0138386

(51) Int. Cl.
*C22C 38/02* (2006.01)
*C21D 8/02* (2006.01)
(Continued)

(52) U.S. Cl.
CPC ..... *C21D 8/0247* (2013.01); *C21D 6/005* (2013.01); *C21D 8/0205* (2013.01);
(Continued)

(58) Field of Classification Search
CPC ..... C21D 2211/001; C21D 2211/008; C21D 8/0205; C21D 8/0226; C21D 8/0247;
(Continued)

(56) References Cited

U.S. PATENT DOCUMENTS 8,480,819 B2 * 7/2013 Futamura ..... C21D 9/46 148/320
10,844,455 B2 * 11/2020 Xu ..... C21D 8/0221
(Continued)

FOREIGN PATENT DOCUMENTS

CN 102912219 2/2013
CN 105026600 11/2015
(Continued)

OTHER PUBLICATIONS

International Search Report—PCT/KR2017/011765 dated Jan. 23, 2018.
(Continued)

*Primary Examiner* — Jie Yang
(74) *Attorney, Agent, or Firm* — Cantor Colburn LLP

(57) ABSTRACT

Provided is an ultra-high-strength steel sheet having an excellent hole expandability and yield ratio, including, in terms of wt %: 0.05-0.2% of carbon (C); 2.0% or less of silicon (Si); 4.1-9.0% of manganese (Mn); 0.05% or less (excluding 0%) of phosphorus (P); 0.02% or less (excluding 0%) of sulfur (S); 0.5% or less (excluding 0%) of aluminum (Al); 0.02% or less (excluding 0%) of nitrogen (N); and a balance of iron (Fe) and other inevitable impurities, wherein the following Equation 1 is satisfied, and wherein microstructures includes, in volume percentage, 10-30% or retained austenite, 50% or more of annealed martensite, and 20% or less of other phases including alpha martensite and epsilon martensite, Equation 1: $C/12+Ti/48+Nb/93+V/51+Mo/96 \geq 0.015$.

9 Claims, 3 Drawing Sheets

(51) Int. Cl.

| | |
|---|---|
| ***C22C 38/00*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C21D 6/00*** | (2006.01) |
| *C23C 2/02* | (2006.01) |
| *C23C 2/06* | (2006.01) |
| *C23C 2/40* | (2006.01) |

(52) U.S. Cl.
CPC ..... *C21D 8/0226* (2013.01); *C21D 8/0263* (2013.01); *C22C 38/001* (2013.01); *C22C 38/02* (2013.01); *C22C 38/04* (2013.01); *C22C 38/06* (2013.01); *C22C 38/12* (2013.01); *C22C 38/14* (2013.01); *C21D 2211/001* (2013.01); *C21D 2211/008* (2013.01); *C23C 2/02* (2013.01); *C23C 2/06* (2013.01); *C23C 2/40* (2013.01)

(58) Field of Classification Search
CPC ..... C21D 8/0263; C22C 38/001; C23C 2/02; C23C 2/06; C23C 2/40
USPC ..... 148/602
See application file for complete search history.

(56) References Cited

U.S. PATENT DOCUMENTS

| | | | | |
|---|---|---|---|---|
| 2006/0162824 | A1 | 7/2006 | Merwin | |
| 2009/0074605 | A1 | 3/2009 | Kim et al. | |
| 2011/0048589 | A1* | 3/2011 | Matsuda | C21D 8/04 148/645 |
| 2012/0031528 | A1 | 2/2012 | Hayashi et al. | |
| 2014/0308156 | A1 | 10/2014 | Oh et al. | |
| 2014/0360632 | A1 | 12/2014 | Hasegawa et al. | |
| 2016/0002762 | A1 | 1/2016 | Fushiwaki et al. | |
| 2017/0145537 | A1 | 5/2017 | Xu et al. | |
| 2017/0298482 | A1 | 10/2017 | Kawasaki et al. | |
| 2019/0211427 | A1 | 7/2019 | Sano et al. | |
| 2020/0248281 | A1* | 8/2020 | Lee | C21D 9/46 |

FOREIGN PATENT DOCUMENTS

| | | | | |
|---|---|---|---|---|
| CN | 108350546 | | 7/2018 | |
| EP | 3372703 | | 9/2018 | |
| JP | 07188834 | | 7/1995 | |
| JP | 2003138345 | | 5/2003 | |
| JP | 2007284776 | | 11/2007 | |
| JP | 2014025091 | | 2/2014 | |
| JP | 2015503023 | | 1/2015 | |
| JP | 2015147960 | | 8/2015 | |
| JP | 2017524822 | | 8/2017 | |
| KR | 19960023167 | | 7/1996 | |
| KR | 20080060982 | | 7/2008 | |
| KR | 20140011498 | | 1/2014 | |
| KR | 20140075789 | | 6/2014 | |
| KR | 20160078839 | | 7/2016 | |
| WO | 2010131303 | | 11/2010 | |
| WO | 2010137317 | | 12/2010 | |
| WO | WO-2016001889 | A2 * | 1/2016 | C21D 1/25 |
| WO | 2016067626 | | 5/2016 | |
| WO | 2018055687 | | 3/2018 | |

OTHER PUBLICATIONS

Chinese Office Action—Chinese Application No. 201780063962.3 dated Jul. 6, 2020, CN 108350546, JP 2003-138345, CN 105026600, and KR 10-2016-0078839.

Japanese Office Action—Japanese Application No. 2019-521405 dated Jul. 28, 2020, WO 2016/067626, JP 2017-524822, WO 2018/055687, WO 2010/137317, WO 2010/131303, JP 2015-147960, US 2006/0162824, and CN 102912219.

European Search Report—European Application No. 17865881.1, dated Jul. 24, 2019, JP 2003 138345, EP 3 372 703, KR 2016 0078839 and JP 2014 025091.

* cited by examiner (a)

(b)

(a)

(b)

ULTRA-HIGH-STRENGTH STEEL SHEET HAVING EXCELLENT HOLE EXPANDABILITY AND YIELD RATIO, AND METHOD OF MANUFACTURING THE SAME

TECHNICAL FIELD

The present disclosure relates to an ultra-high-strength steel sheet having excellent hole expandability and yield ratio, which may be suitably applied to automotive structural members, and a method of manufacturing the same.

BACKGROUND ART

Safety regulations, with respect to motor vehicles, for securing the safety of passengers in the event of a collision, and becoming stricter, and to this end, it is necessary to improve the strength of steel sheets for motor vehicles or to increase the thicknesses thereof. Also, since there has been continuously increasing demand for weight reduction of car bodies, in order to comply with regulations for $CO_2$ emissions of automobiles, and to improve energy efficiency, it is necessary for steel sheets for motor vehicles to possess high strength.

However, increasing the strength of steel sheets for motor vehicles tends to decrease the ductility thereof, and thus, in the case of ultra-high-strength steels, such a technique may be limited for parts that require bendability.

To overcome such disadvantages of ultra-high-strength steels, there have been developed hot press-formed steels, wherein parts are formed at high temperature, while having sufficient bendability, and are then quenched to room temperature, to secure low-temperature structures and thereby achieve high ultimate yield strength and tensile strength.

However, such solutions may cause the costs of automotive parts to inevitably increase, due to increases in processing costs and facility costs associated with newly installed hot press forming facilities for automotive parts manufacturers.

In the above context, continuous research has been focused on steel materials that exhibit excellent elongation ratios as well as high strength, and are capable of cold-press forming.

For example, Korean Laid-Open Patent Publication No. 1996-0023167 proposes an ultra-high-strength steel sheet exhibiting a tensile strength of 900 MPa and an extremely desirable ductility around 20-30% by including 0.05-0.15% of carbon (C) and 5.0-10.0% of manganese (Mn). However, in Korean Laid-Open Patent Publication No. 1996-0023167, for the lack of consideration of yield strength, the proposed ultra high-strength steel sheet may exhibit inferior collision characteristics as automotive structural members, and for the lack of consideration of hole expansion ratio, may suffer crack formation in front edge portions during cold-press forming performed to replace hot-press forming.

In addition, Korean Laid-Open Patent Publication No. 2008-0060982 proposes a steel sheet with excellent processability and collision characteristics, which exhibits a tensile strength of 1,000 MPa or higher, a yield strength of 750 MPa or higher, and a percent elongation of 20% or higher by including 0.2-1.5% of carbon (C) and 10-25% of manganese (Mn). However, in Korean Laid-Open Patent Publication No. 2008-0060982, excellent yield strength is secured by re-rolling (cold rolling) after hot rolling, and thus, anisotropic properties may arise due to a final rolling process while the manufacturing costs increase due to an addition of a large quantity of manganese (Mn) and an additional rolling process.

Accordingly, it is necessary to develop an ultra-high-strength steel sheet that has excellent hole expansion ratio and yield ratio, and thus can be cold-press formed without an additional re-rolling (cold rolling) process after hot rolling, and a method of manufacturing the same.

DISCLOSURE

Technical Problem

An aspect of the present disclosure is to provide an ultra-high-strength steel sheet having an excellent hole expandability and yield ratio which may be suitably applied to automotive structural members, and a method of manufacturing the same.

However, it should be understood that the objects of the present disclosure are not limited to the above-mentioned objects, and other objects will be clearly understood from the following description by those skilled in the relevant art without excessive difficulties.

Technical Solution

An aspect of the present disclosure provides an ultra-high-strength steel sheet having an excellent hole expandability and yield ratio, comprising, in wt %, 0.05-0.2% of carbon (C), 2.0% or less of silicon (Si), 4.1-9.0% of manganese (Mn), 0.05% or less (excluding 0%) of phosphorus (P), 0.02% or less (excluding 0%) of sulfur (S), 0.5% or less (excluding 0%) of aluminum (Al), 0.02% or less (excluding 0%) of nitrogen (N), and a balance of iron (Fe) and other inevitable impurities, wherein the ultra-high-strength steel sheet further comprises at least one selected from 0.1% or less (excluding 0%) of titanium (Ti), 0.1% or less (excluding 0%) of niobium (Nb), 0.2% or less (excluding 0%) of vanadium (V), and 0.5% or less (excluding 0%) of molybdenum (Mo), and satisfies the following Equations 1, and wherein the microstructure thereof includes, in volume percent, 10-30% of retained austenite, 50% or more of annealed martensite, and 20% or less of other phases including alpha martensite and epsilon martensite.

$$C/12+Ti/48+Nb/93+V/51+Mo/96 \geq 0.015 \quad \text{Equation 1:}$$

(In Equation 1, each element symbol represents a value of the content of each element, expressed in wt %.)

In addition, another aspect of the present disclosure provides a method of manufacturing an ultra-high-strength steel sheet having excellent hole expandability and yield ratio, comprising: an operation of heating a slab satisfying the above-described alloy composition to 1,050-1,300° C.;

an operation of finish hot rolling the heated slab in a temperature range of 800-1,000° C. to produce a hot-rolled steel sheet;

an operation of coiling the hot-rolled steel sheet at 750° C. or less and cooling the same;

and an annealing heat treatment operation of heating the cooled hot-rolled steel sheet to a temperature within a range of 590-690° C., maintaining the same for 40 seconds or more, and cooling the same.

Not all features of the present disclosure are listed in the above-described technical solution to the problem. Various features and advantages, and effects resulted therefrom will be more easily understood through description of exemplary embodiments below.

Advantageous Effects

According to the present disclosure, there may be provided an ultra-high-strength steel sheet having excellent hole expandability and yield ratio, which can be cold-pressed without a rerolling process after hot rolling, and a method of manufacturing the same.

In addition, the ultra-high-strength steel sheet of the present disclosure, due to excellent strength and elongation ratio, satisfies bendability and collision safety required of automotive steel sheets; and due to excellent yield ratio, hole expandability, and elongation ratio, may be alternative to existing hot-pressed steel sheets, thus reducing manufacturing costs.

DESCRIPTION OF DRAWINGS

FIG. 2 is for observing the sizes and shapes of grains in the final annealed structures, wherein in (b), dark grey indicates annealed martensite and light grey indicates austenite.

FIG. 3 is for observing the sizes and number of micro precipitates.

BEST MODE FOR INVENTION

Figure 1:
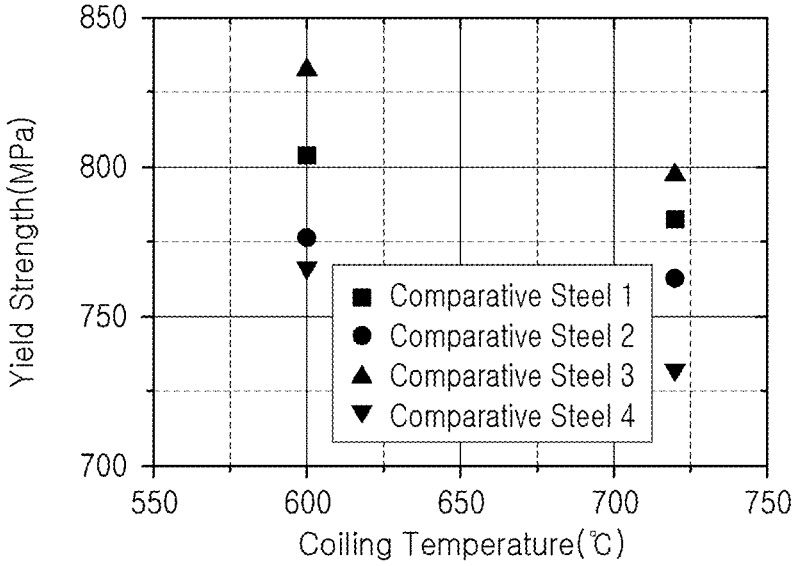
FIG. 1 is graph illustrating changes in (a) yield strength and (b) tensile strength according to the coiling temperature of hot-rolled steel sheets of Comparative Steels 1-4.
Figure 1:
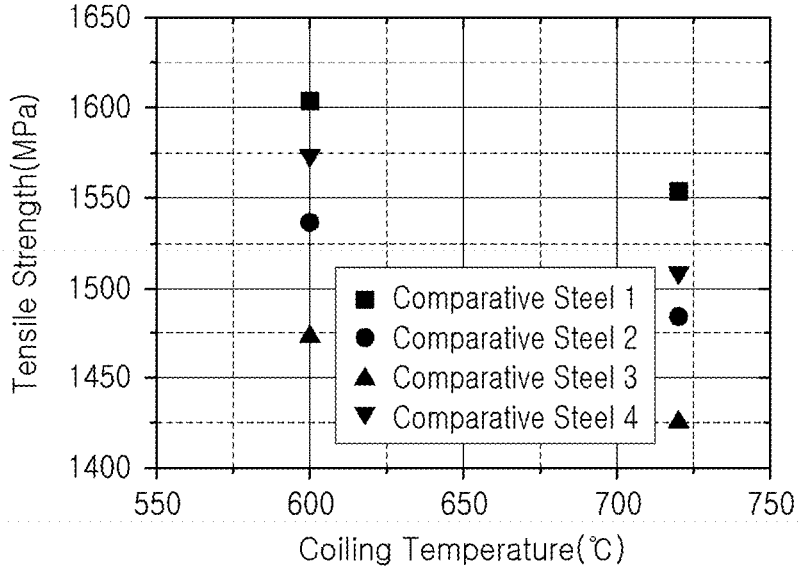

Hereinbelow, exemplary embodiments of the present disclosure are described. However, the exemplary embodiments of the present disclosure may be modified in various other forms, and the scope of the present disclosure should not be construed as to being limited to the embodiments discussed hereinbelow. Also, the embodiments of the present disclosure are provided to provide a more complete understanding to those skilled in the art.

Ultra-High-Strength Steel Sheet Having an Excellent Hole Expandability and Yield Ratio.

Hereinbelow, an ultra-high-strength steel sheet having an excellent hole expandability and yield ratio according to an aspect of the present disclosure is described in detail.

An ultra-high-strength steel sheet having an excellent hole expandability and yield ratio according to an aspect of the present disclosure comprises, in wt %, 0.05-0.2% of carbon (C), 2.0% or less of silicon (Si), 4.1-9.0% of manganese (Mn), 0.05% or less (excluding 0%) of phosphorus (P), 0.02% or less (excluding 0%) of sulfur (S), 0.5% or less (excluding 0%) of aluminum (Al), 0.02% or less (excluding 0%) of nitrogen (N), and a balance of iron (Fe) and other inevitable impurities, wherein the ultra-high-strength steel sheet further comprises at least one selected from 0.1% or less (excluding 0%) of titanium (Ti), 0.1% or less (excluding 0%) of niobium (Nb), 0.2% or less (excluding 0%) of vanadium (V), and 0.5% or less (excluding 0%) of molybdenum (Mo), and satisfies the following Equation 1, wherein a microstructure thereof includes, in volume percent, 10-30% of retained austenite, 50% or more of annealed martensite, and 20% or less of other phases including alpha martensite and epsilon martensite.

$$C/12+Ti/48+Nb/93+V/51+Mo/96 \geq 0.015 \quad \text{Equation 1:}$$

(In Equation 1, each element symbol represents a value of the content of each element, expressed in wt %.)

First, an alloy composition of the present disclosure will be described in greater detail. The content of each element is provided in wt %, unless otherwise specified.

C: 0.05-0.2%

Carbon (C) is an element effective for strengthening steel, and in the present disclosure, is a crucial element added to control stability of austenite and to secure strength.

If the content of carbon (C) is less than 0.05%, the above-described effects may be insufficient, and if the content of carbon (C) is greater than 0.2%, hole expandability and spot weldability may be undesirably degraded due to an increase in hardness differences among the microstructures.

Accordingly, the content of carbon (C) is preferably in the range of 0.05-0.2%. More preferably, the content of carbon (C) is in the range of 0.1-0.2%, and even more preferably, is in the range of 0.13-0.2%.

Si: 2.0% or Less

Silicon (Si) is an element suppressing the precipitation of carbides in ferrite and promoting carbon in ferrite to diffuse into austenite, thus contributing to the stabilization of retained austenite.

Since the content of silicon (Si) exceeding 2% may severely degrade hot rolling properties and cold rolling properties, and may degrade hot dip galvanizability by forming silicon (Si) oxides on steel surfaces, the content of silicon (Si) is preferably limited to 2% or less.

Meanwhile, in the present disclosure, 0% of silicon can be included. As will be described later, due to containing a large quantity of manganese (Mn), the stability of retained austenite can be easily secured without the addition of silicon (Si). More preferably, the content of silicon (Si) is 1.5% or less, and even more preferably, the content of silicon (Si) is 1.1% or less.

Mn: 4.1-9.0%

Manganese (Mn) is an element effective for suppressing the transformation of ferrite and for formation and stabilization of retained austenite.

The content of manganese (Mn) less than 4.1% causes insufficient stability of retained austenite, and thus causes degradation in mechanical properties due to a decrease in an elongation ratio. On the other hand, the content of manganese (Mn) exceeding 9.0% causes an undesirable increase in manufacturing costs and a degradation of spot weldability.

Accordingly, the content of manganese (Mn) is preferably in the range of 4.1-9.0%, more preferably in the range of 5-9%, and more preferably, in the range of 5-8%.

P: 0.05% or Less (Excluding 0%)

Phosphorus (P) is an element for solid-solution strengthening. Since the content of phosphorus (P) exceeding 0.05% degrades weldability and increases the risk of brittleness in steel, it may be preferable to limit the upper limit thereof to 0.05%, and more preferably, to 0.02% or less.

S: 0.02% or Less (Excluding 0%)

Sulfur (S) is an impurity element inevitably included in steel, and is an element that decreases ductility and weldability of a steel sheet. Since the content of sulfur (S) exceeding 0.02% increases the possibility of degrading the ductility and weldability of a steel sheet, it may be preferable to limit the upper limit thereof to 0.02%.

Al: 0.5% or Less (Excluding 0%)

Aluminum (Al) is an element typically added for acid removal of steel. The content of aluminum (Al) exceeding 0.5% causes a decrease in tensile strength of steel, complicates the manufacturing of a decent slab through a reaction with mold plus during casting, and forms surface oxides, thus degrading coatability. Accordingly, it may be preferable to limit the content of aluminum (Al) to 0.5% or less, excluding 0%, in the present disclosure.

N: 0.02% or Less (Excluding 0%)

Nitrogen (N) is a solid-solution strengthening element. However, the content of nitrogen (N) exceeding 0.02% has a high risk of causing brittleness and may bind with aluminum (Al) to give rise to excessive precipitation of aluminum nitride (AlN), degrading the quality of continuous casting. Therefore, it may be preferable to limit the upper limit of the content of nitrogen (N) to 0.02% in the present disclosure.

Other than the above-described alloying elements, at least one selected from the following may be included: 0.1% or less (excluding 0%) of titanium (Ti); 0.1% or less (excluding 0%) of niobium (Nb); 0.2% or less (excluding 0%) of vanadium (V); and 0.5% or less (excluding 0%) of molybdenum (Mo).

Ti: 0.1% or Less (Excluding 0%)

Titanium (Ti) is a micro carbide forming element which contributes to securing yield strength and tensile strength.

In addition, titanium (Ti) is a nitride forming element having the effect of precipitating nitrogen (N) in steel as titanium nitride (TiN), thereby suppressing aluminum nitride (AlN) precipitation, and may advantageously reduce the risk of crack formation during continuous casting.

Contents of titanium (Ti) exceeding 0.1% may give rise to precipitation of coarse carbides, may reduces strength and elongation ratio due to a decreased carbon content in steel, and may cause clogging of nozzles during continuous casting.

Nb: 0.1% or Less (Excluding 0%)

Niobium (Nb) is an element which segregates to austenite grain boundaries to suppress coarsening of austenite grains during annealing heat treatment, and contributes to an increase in strength by forming micro-carbides.

The content of niobium (Nb) exceeding 0.1% may give rise to precipitation of coarse carbides, may cause a decrease in strength and elongation ratio due to decreased carbon content in steel, and may undesirably increase manufacturing costs.

V: 0.2% or Less (Excluding 0%)

Vanadium (V) is an element which reacts with carbon or nitrogen to form carbides or nitrides. In the present disclosure, vanadium (V) plays an important role in increasing the yield strength of steel by forming micro precipitates at low temperature.

The content of vanadium (V) exceeding 0.2% may give rise to precipitation of coarse carbides, may cause a decrease in strength and elongation ratio due to a decreased carbon content in steel, and may undesirably increase manufacturing costs.

Mo: 0.5% or Less (Excluding 0%)

Molybdenum (Mo) is a carbide forming element which, when added in combination with carbide or nitride forming elements such as titanium (Ti), niobium (Nb), and vanadium (V), plays a role in maintaining the size of precipitates to be small and thus improving yield strength and tensile strength.

The content of molybdenum (Mo) exceeding 0.5% may saturate the above-described effects and may rather increase manufacturing costs.

The remaining component of the present disclosure is iron (Fe). However, since unintended impurities may be inevitably introduced from raw materials or the surrounding environment during conventional manufacturing processes, such impurities should not be excluded. Since such impurities are well known to those skilled in the conventional manufacturing processes, they will not be further described in the present description.

Here, the alloy composition of the present disclosure should satisfy the above-described content of each element while satisfying the following Equation 1.

$$C/12+Ti/48+Nb/93+V/51+Mo/96 \geq 0.015 \quad \text{Equation 1:}$$

(In Equation 1, each element symbol represents a value of the content of each element, expressed in wt %.)

In the present disclosure, the Equation 1 is derived to study the effect of elements influencing steel properties through formation of micro precipitates of complex carbonitrides, such as carbon (C), titanium (Ti), niobium (Ni), and molybdenum (Mo). In particular, within the ranges that satisfy the above-described content of each element, most of the complex carbonitrides bind in 1:1 atomic ratios, and therefore, when the sum of values produced by dividing an added amount of each of the following elements, carbon (C), titanium (Ti), niobium (Nb), vanadium (V), and molybdenum (Mo), by the atomic mass of the corresponding element, which are 12, 48, 93, 51, and 96, respectively, is greater than 0.015, tensile strength and yield ratio may be secured.

Meanwhile, other than the above-described components, at least one selected among 1% or less (excluding 0%) of nickel (Ni), 0.5% or less (excluding 0%) of copper (Cu), 1% or less (excluding 0%) of chromium (Cr), and 0.01-0.1% of antimony (Sb) may be additionally included.

Nickel (Ni), copper (Cu) and chromium (Cr) are the elements contributing to stabilization of retained austenite, and contribute to austenite stabilization through complexing actions with the above-described copper (C), silicon (Si), manganese (Mn), aluminum (Al), and the like. However, nickel (Ni) and chromium (Cr) contents each higher than 1%, and copper (Cu) contents higher than 0.5% may excessively increase manufacturing costs. In addition, since copper (Cu) may cause brittleness during hot rolling, when copper (Cu) is added, nickel (Ni) may be added in combination therewith.

Antimony (Sb) has an effect of suppressing internal oxidation after hot rolling by suppressing migration of oxidizing elements and surface segregation of silicon (Si), aluminum (Al), and the like through segregation at grain boundaries; and for the same reason, has an effect of improving plating surface quality by suppressing oxidation due to surface segregation of silicon (Si), aluminum (Al), and the like, during annealing. However, antimony (Sb) contents lower than 0.01% may produce unsatisfactory effects of suppressing internal oxidation layers, whereas antimony (Sb) contents greater than 0.1% may cause an undesirable delay in alloying of zinc alloy layers.

In addition, the microstructure of a steel sheet of the present disclosure includes, in volume percent, 10-30% of retained austenite, 50% or more of annealed martensite, and 20% or less of other phases including alpha martensite and epsilon martensite.

When retained austenite is greater than 30%, the stability of austenite decreases, so the elongation ratio decreases, and the amount of plasticity-induced transformed martensite increases, thus undesirably degrading hole expandability; however, when retained austenite is less than 10%, retained austenite is too stable and has too small a fraction, contributing too little to the elongation ratio. Moreover, the case where annealed martensite is less than 50%, or other phases including alpha martensite and epsilon martensite are greater than 20% are not preferable, because these cases also mean a decrease of retained austenite stability, drastically decreases elongation ratio.

Here, to effectively secure hole expansion ratio and strength improvement due to precipitates, the steel sheets of the present disclosure may include 10^(13) ea/m^2 or more of precipitates having a size of 30 nm or less, wherein the precipitates may be carbides, nitrides, or complex carbonitrides, including at least one of titanium (Ti), niobium (Nb), vanadium (V), and molybdenum (Mo).

In addition, since the retained austenite and the annealed martensite show a relatively superior hole expandability when formed in acicular shapes, they may have a ratio of the short axis to the long axis of 0.5 or less.

However, as of the steel sheet of the present disclosure, the hole expandability may be 15% or more, the yield ratio may be 0.65 or more, the tensile strength may be 900 MPa or more, and the product of the tensile strength and the elongation rate may be 23,000 MPa % or more. By satisfying these properties, the steel sheet does not suffer crack formation in front edge portions even when cold forming, and thus may replace hot press forming, and may satisfy moldability and collision safety required of automotive steel sheets.

In addition, the steel sheet of the present disclosure may include a plating layer formed additionally formed on the surface thereof.

For example, the plating layer may be a zinc plating layer or an aluminum plating layer.

Also, the steel sheet of the present disclosure may include an alloyed plating layer additionally formed on the surface thereof. For example, the alloyed plating layer may be an alloyed zinc plating layer or an alloyed aluminum plating layer.

Method of Manufacturing Ultra-High-Strength Steel Sheet Having an Excellent Hole Expandability and Yield Ratio.

Hereinbelow, a method of manufacturing an ultra-high-strength steel sheet having an excellent hole expandability and yield ratio according to another aspect of the present disclosure will be described in greater detail.

A method of manufacturing an ultra-high-strength steel sheet having an excellent hole expandability and yield ratio according to another aspect of the present disclosure includes: an operation of heating a slab satisfying the above-described alloying composition to 1,050-1,300° C.; an operation of finish hot rolling the heated slab in a temperature range of 800-1,000° C. to obtain a hot-rolled steel sheet; an operation of coiling the hot-rolled steel sheet at 750° C. or less and cooling the same; and an annealing operation of heating the cooled hot-rolled steel sheet to a temperature within a range of 590-690° C., maintaining the same for 40 seconds or more, and cooling the same.

Slab Heating Operation

A slab satisfying the above-described alloying composition is heated to 1,050-1,300° C. This is for having the slab homogenized prior to hot rolling.

Slab heating temperatures less than 1,050° C. may cause an undesirable sharp increase of load during a subsequent hot rolling, whereas slab heating temperatures exceeding 1,300° C. may not only increase energy cost but also increase the amount of surface scales, leading to loss of materials, and may retain liquid when manganese (Mn) is contained in a large quantity.

Hot Rolling Operation

The heated slab is subjected to finish hot rolling in the temperature range of 800-1,000° C. to produce a hot-rolled steel sheet.

Finish hot rolling temperatures less than 800□ may cause an undesirable significant increase in rolling load, whereas finish hot rolling temperatures exceeding 1,000° C. may reduce the lifespan of rolling rolls and may cause surface defects due to scales.

Coiling and Cooling Operation

The hot-rolled steel sheet is coiled at 750° C. or less, and then cooled.

Coiling temperatures higher than 750° C. may give rise to excessive scale formation on the surface of a steel sheet, causing defects, and this may be a factor contributing to degradation of pickling performance and coatability.

In detail, in the case where manganese (Mn) is included in 4.1% or more of the steel composition, hardenability increases, so even when air-cooled to room temperature after coiling, most microstructures transform to martensitic structures without transformation of ferrite; however, as confirmed in FIG. 1, which is a graph illustrating changes in (a) yield strength and (b) tensile strength of the hot-rolled steel sheets of Comparative Steels 1-4 according to coiling temperature, the lower the coiling temperature, the higher the yield strength and tensile strength increase, providing advantages in securing the strength of the final annealed material. Thus, it may be more preferable to lower the coiling temperature by water cooling after hot rolling.

Annealing Operation

The cooled hot-rolled steel sheet is heated to a temperature within a range of 590-690° C., maintained for 40 seconds or more, and then cooled, thereby carrying out an annealing heat treatment.

Here, an operation of plating the annealed heat-treated hot-rolled steel sheet to produce a plated steel sheet may be additionally included. There is no need to particularly limit plating conditions, and the plating may be conducted according to conditions known in the relevant art by using an electroplating method, a hot-dip coating method, or the like. For example, the annealed hot-rolled steel sheet may be deposited in a galvanizing bath to produce a galvanized steel sheet.

In addition, an operation of alloying the plated steel sheet to produce an alloyed plated steel sheet may be further included.

MODE FOR INVENTION

Hereinbelow, the present disclosure will be described in greater detail with reference to exemplary embodiments. However, these embodiments should be regarded as illustrative rather than restrictive, and the present disclosure should not be construed as being limited to particular embodiments discussed, since the scope of the present disclosure is defined by the appended claims and equivalents thereof.

EXAMPLE

Steels having compositions shown in Table 1 were vacuum melted into 30 Kg ingots, which were heated to 1,200° C. and maintained for one hour. Thereafter, these ingots were subjected to finish hot rolling at 900° C. to produce hot-rolled steel sheets, and the hot-rolled steel sheets were cooled to coiling temperatures shown in Table 2, placed in a furnace preheated to a corresponding temperature, maintained for one hour, and then furnace-cooled to mimic hot coiling. Next, each sample was cooled to room temperature and subjected to an annealed heat treatment under the conditions shown in Table 2. Then, the microstructures and mechanical properties of each sample were measured, and the results are presented in Table 3.

In Table 3, yield strength, tensile strength, elongation ratio, and yield ratio were measured by using a universal testing machine. A hole expansion ratios (HER) was measured and evaluated using the same standard across all samples.

TABLE 1

| Steel | Composition (wt %) | | | | | | | | | | | |
|---|---|---|---|---|---|---|---|---|---|---|---|---|
| Type | C | Si | Mn | Al | Ti | Nb | V | Mo | P | S | N | Equation 1 |
| IS 1* | 0.14 | 1 | 5 | 0.015 | 0.06 | 0.04 | 0 | 0.25 | 0.01 | 0.006 | 0.005 | 0.0160 |
| IS 2 | 0.158 | 1.1 | 5.1 | 0.02 | 0 | 0 | 0.11 | 0 | 0.009 | 0.004 | 0.006 | 0.0153 |
| IS 3 | 0.14 | 1 | 6 | 0.017 | 0.06 | 0.04 | 0 | 0.25 | 0.008 | 0.005 | 0.005 | 0.0160 |
| IS 4 | 0.161 | 1.1 | 6.2 | 0.018 | 0 | 0 | 0.117 | 0 | 0.009 | 0.006 | 0.006 | 0.0157 |
| IS 5 | 0.14 | 1 | 7 | 0.019 | 0.06 | 0.04 | 0 | 0.25 | 0.007 | 0.008 | 0.007 | 0.0160 |
| IS 6 | 0.19 | 0.5 | 7 | 0.02 | 0.03 | 0 | 0.1 | 0 | 0.009 | 0.009 | 0.009 | 0.0184 |
| IS 7 | 0.14 | 1 | 8 | 0.021 | 0.06 | 0.04 | 0 | 0.25 | 0.008 | 0.009 | 0.004 | 0.0160 |
| CS 1** | 0.14 | 0.5 | 7 | 0.015 | 0.03 | 0.04 | 0 | 0 | 0.008 | 0.008 | 0.009 | 0.0127 |
| CS 2 | 0.14 | 0.1 | 7 | 0.019 | 0.06 | 0.04 | 0 | 0 | 0.009 | 0.009 | 0.004 | 0.0133 |
| CS 3 | 0.12 | 0.1 | 7 | 0.022 | 0.06 | 0 | 0 | 0.25 | 0.01 | 0.005 | 0.007 | 0.0139 |
| CS 4 | 0.14 | 0.5 | 7 | 0.023 | 0.03 | 0 | 0 | 0 | 0.006 | 0.007 | 0.006 | 0.0123 |
| CS 5 | 0.16 | 0.1 | 6 | 0.017 | 0.02 | 0.01 | 0 | 0 | 0.008 | 0.006 | 0.005 | 0.0139 |
| CS 6 | 0.136 | 0.1 | 6 | 0.019 | 0.02 | 0.01 | 0 | 0.1 | 0.007 | 0.009 | 0.009 | 0.0120 |
| CS 7 | 0.157 | 1 | 4 | 0.018 | 0 | 0 | 0.1 | 0 | 0.005 | 0.008 | 0.004 | 0.0150 |
| CS 8 | 0.14 | 1 | 10 | 0.018 | 0.06 | 0.04 | 0 | 0.25 | 0.01 | 0.004 | 0.005 | 0.0160 |
| CS 9 | 0.1 | 1 | 10 | 0.02 | 0.06 | 0.04 | 0 | 0.25 | 0.012 | 0.006 | 0.006 | 0.0126 |
| CS 10 | 0.06 | 1 | 10 | 0.02 | 0.06 | 0.04 | 0 | 0.25 | 0.008 | 0.007 | 0.005 | 0.0093 |

*IS: Inventive Steel

**CS: Comparative Steel

TABLE 2

| Category | | Coiling temp (° C.) | Annealing conditions | |
|---|---|---|---|---|
| | | | Temp (° C.) | Time (S) |
| IS 1* | IE 1*** | 600 | 640 | 72000 |
| IS 2 | IE 2 | 600 | 640 | 108000 |
| IS 3 | IE 3 | 600 | 620 | 72000 |
| | IE 4 | 600 | 640 | 72000 |
| IS 4 | IE 5 | 600 | 600 | 108000 |
| | IE 6 | 600 | 620 | 108000 |
| IS 5 | CE 1**** | 600 | 0 | 0 |
| | CE 2 | 600 | 550 | 108000 |
| | CE 3 | 600 | 580 | 54000 |
| | IE 7 | 600 | 600 | 18000 |
| | IE 8 | 600 | 600 | 36000 |
| | IE 9 | 600 | 600 | 72000 |
| | IE 10 | 600 | 600 | 108000 |
| | IE 11 | 600 | 610 | 54000 |
| | IE 12 | 600 | 630 | 54000 |
| | IE 13 | 600 | 650 | 54000 |
| | IE 14 | 600 | 660 | 71 |
| | CE 4 | 600 | 660 | 35 |
| | CE 5 | 600 | 700 | 35 |
| IS 6 | CE 6 | 600 | 550 | 36000 |
| | IE 15 | 600 | 600 | 36000 |
| IS 7 | CE 7 | 600 | 550 | 72000 |
| | IE 16 | 600 | 600 | 32400 |
| | IE 17 | 600 | 600 | 72000 |

TABLE 2-continued

| Category | | Coiling temp (° C.) | Annealing conditions | |
|---|---|---|---|---|
| | | | Temp (° C.) | Time (S) |
| CS 1** | CE 8 | 720 | — | — |
| | CE 9 | 600 | — | — |
| CS 2 | CE 10 | 720 | — | — |
| | CE 11 | 600 | — | — |
| CS 3 | CE 12 | 720 | — | — |
| | CE 13 | 600 | — | — |
| CS 4 | CE 14 | 720 | — | — |
| | CE 15 | 600 | — | — |
| CS 5 | CE 16 | 600 | 600 | 72000 |
| | CE 17 | 600 | 640 | 72000 |

TABLE 2-continued

| Category | | Coiling temp (° C.) | Annealing conditions | |
|---|---|---|---|---|
| | | | Temp (° C.) | Time (S) |
| CS 6 | CE 18 | 600 | 600 | 72000 |
| | CE 19 | 600 | 660 | 72000 |
| CS 7 | CE 20 | 600 | 600 | 108000 |
| | CE 21 | 600 | 640 | 108000 |
| CS 8 | CE 22 | 600 | 550 | 72000 |
| | CE 23 | 600 | 600 | 72000 |
| CS 9 | CE 24 | 600 | 550 | 72000 |
| | CE 25 | 600 | 600 | 72000 |
| CS 10 | CE 26 | 600 | 550 | 72000 |
| | CE 27 | 600 | 600 | 72000 |

*IS: Inventive Steel

**CS: Comparative Steel

***IE: Inventive Example

****CE: Comparative Example

TABLE 3

| Category | | Microstructure (vol %) Annealed martensite | Retained austenite | Other phase | Number of precipitates ($/m^2$) | YS (MPa) | TS (MPa) | El (%) | TS*El (MPa %) | YR | HER (%) |
|---|---|---|---|---|---|---|---|---|---|---|---|
| IS 1* | IE 1*** | 77 | 20 | 3 | $1 \times 10^{14}$ | 947 | 1054 | 22 | 23188 | 0.9 | 21 |
| IS 2 | IE 2 | 75 | 22 | 3 | $1 \times 10^{14}$ | 629 | 940 | 27 | 25380 | 0.67 | 22 |
| IS 3 | IE 3 | 74 | 23 | 3 | $9 \times 10^{13}$ | 983 | 1129 | 28 | 31612 | 0.87 | 18 |
| | IE 4 | 72 | 24 | 4 | $3 \times 10^{14}$ | 961 | 1144 | 27.4 | 31346 | 0.84 | 16 |
| IS 4 | IE 5 | 74 | 24 | 2 | $8 \times 10^{13}$ | 793 | 954 | 26 | 24804 | 0.83 | 23 |
| | IE 6 | 73 | 25 | 2 | $2 \times 10^{14}$ | 712 | 966 | 36 | 34776 | 0.74 | 21 |
| IS 5 | CE 1**** | 0 | 7 | 93 | $5 \times 10^{6}$ | 885 | 1580 | 10.3 | 16274 | 0.56 | 7 |
| | CE 2 | 84 | 14 | 2 | $5 \times 10^{9}$ | 983 | 1264 | 14.3 | 18075 | 0.78 | 17 |
| | CE 3 | 83 | 15 | 2 | $2 \times 10^{12}$ | 948 | 1228 | 16.5 | 20262 | 0.77 | 16 |
| | IE 7 | 77 | 21 | 2 | $6 \times 10^{13}$ | 914 | 1217 | 24.8 | 30182 | 0.75 | 19 |
| | IE 8 | 77 | 22 | 1 | $8 \times 10^{13}$ | 944 | 1199 | 24.2 | 29016 | 0.79 | 21 |
| | IE 9 | 73 | 24 | 3 | $1 \times 10^{14}$ | 947 | 1184 | 22.2 | 26285 | 0.8 | 21 |
| | IE 10 | 72 | 25 | 3 | $2 \times 10^{14}$ | 893 | 1191 | 27.9 | 33229 | 0.75 | 21 |
| | IE 11 | 75 | 21 | 4 | $1 \times 10^{14}$ | 926 | 1196 | 20.1 | 24040 | 0.77 | 25 |
| | IE 12 | 72 | 22 | 6 | $6 \times 10^{14}$ | 870 | 1184 | 28.1 | 33270 | 0.73 | 20 |
| | IE 13 | 68 | 25 | 7 | $7 \times 10^{13}$ | 858 | 1188 | 27.6 | 32789 | 0.72 | 23 |
| | IE 14 | 72 | 26 | 2 | $2 \times 10^{13}$ | 1007 | 1361 | 21.3 | 28989 | 0.74 | 16 |
| | CE 4 | 81 | 17 | 2 | — | 991 | 1342 | 15.7 | 21067 | 0.74 | 14 |
| | CE 5 | 68 | 25 | 7 | — | 418 | 1619 | 16.9 | 27425 | 0.26 | 3 |
| IS 6 | CE 6 | 83 | 13 | 4 | — | 885 | 1205 | 12.6 | 15183 | 0.73 | 18 |
| | IE 15 | 77 | 19 | 4 | $5 \times 10^{13}$ | 753 | 1139 | 20.5 | 23350 | 0.66 | 21 |
| IS 7 | CE 7 | 89 | 10 | 1 | — | 1049 | 1328 | 12.7 | 16866 | 0.79 | 16 |
| | IE 16 | 80 | 18 | 2 | $5 \times 10^{13}$ | 972 | 1275 | 18.3 | 23333 | 0.76 | 19 |
| | IE 17 | 74 | 23 | 3 | $3 \times 10^{14}$ | 985 | 1261 | 23.8 | 30012 | 0.78 | 17 |
| CS 1** | CE 8 | 0 | 5 | 95 | — | 783 | 1554 | 9 | 13861 | 0.5 | — |
| | CE 9 | 0 | 6 | 94 | — | 804 | 1603 | 9 | 13674 | 0.5 | — |
| CS 2 | CE 10 | 0 | 5 | 95 | — | 759 | 1482 | 9 | 13201 | 0.51 | — |
| | CE 11 | 0 | 7 | 93 | — | 776 | 1537 | 8 | 12525 | 0.51 | — |
| CS 3 | CE 12 | 0 | 6 | 94 | — | 800 | 1425 | 9 | 13455 | 0.56 | — |
| | CE 13 | 0 | 6 | 94 | — | 833 | 1473 | 8 | 11723 | 0.57 | — |
| CS 4 | CE 14 | 0 | 7 | 93 | — | 730 | 1509 | 9 | 13925 | 0.48 | — |
| | CE 15 | 0 | 5 | 95 | — | 766 | 1573 | 9 | 14113 | 0.49 | — |
| CS 5 | CE 16 | 79 | 19 | 2 | — | 633 | 797 | 23 | 18331 | 0.79 | — |
| | CE 17 | 64 | 31 | 5 | — | 568 | 885 | 40 | 35400 | 0.64 | — |
| CS 6 | CE 18 | 79 | 19 | 2 | — | 579 | 732 | 34.1 | 24961 | 0.79 | — |
| | CE 19 | 73 | 24 | 3 | — | 455 | 904 | 16.1 | 14554 | 0.5 | — |
| CS 7 | CE 20 | 86 | 13 | 1 | — | 728 | 798 | 17 | 13566 | 0.91 | — |
| | CE 21 | 77 | 21 | 2 | — | 573 | 805 | 23 | 18515 | 0.71 | — |
| CS 8 | CE 22 | 71 | 23 | 6 | — | 461 | 1638 | 18.1 | 29648 | 0.28 | — |
| | CE 23 | 62 | 27 | 11 | — | 403 | 1617 | 19.9 | 32178 | 0.25 | — |
| CS 9 | CE 24 | 79 | 16 | 5 | — | 475 | 1474 | 15.9 | 23437 | 0.32 | — |
| | CE 25 | 77 | 19 | 4 | — | 429 | 1472 | 17.1 | 25171 | 0.29 | — |
| CS 10 | CE 26 | 83 | 13 | 4 | — | 612 | 1341 | 14.2 | 19042 | 0.46 | — |
| | CE 27 | 81 | 16 | 3 | — | 525 | 1246 | 15.3 | 19064 | 0.42 | — |

*IS: Inventive Steel
**CS: Comparative Steel
***IE: Inventive Example
****CE: Comparative Example In Table 3, YS: yield strength, TS: tensile strength, El: percent elongation, YR: yield ratio (YS/TS), and HER: hole expansion ratio.

It could be confirmed that Inventive Examples 1-17, satisfying both the alloy composition and the manufacturing conditions proposed in the present disclosure, are of ultra-high strength having a tensile strength of 900 MPa or more, have an yield ratio of 0.65 or more, and have excellent elongation rate that a product of tensile strength x elongation rate is 23,000 MPa % or higher. Further, it could be confirmed that Inventive Examples 1-17, due to having a hole expansion ratio of 15% or more, would be extremely advantageous as a cold-pressed steel sheet that can replace existing hot-pressed steel sheets.

The result of analysis of the microstructure of Inventive Example 12 showed that in volume percentage, 22% of retained austenite, 72% of annealed martensite, and 6% of epsilon martensite.

Figure 2:
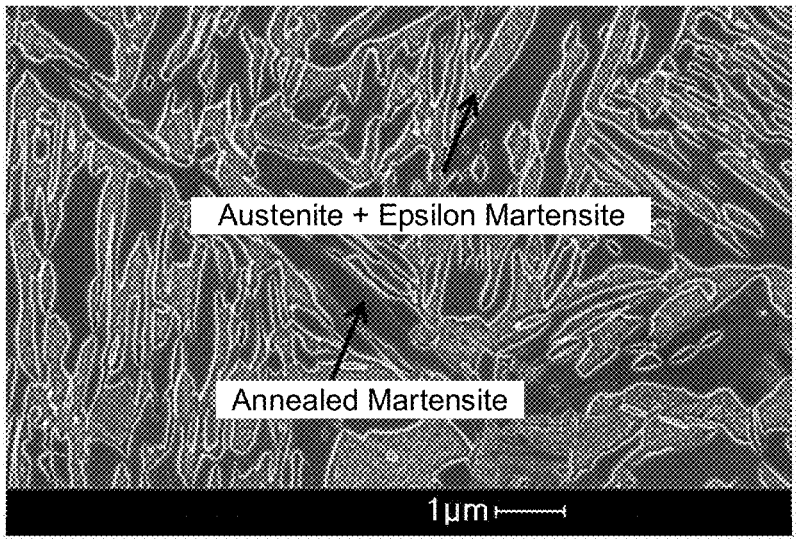
FIG. 2 are photographs of the microstructure of a hot-rolled steel sheet of the Inventive Example having undergone a finish annealing heat treatment, captured by (a) scanning electron microscope (SEM) and (b) electron backscatter diffraction (EBSD).
Figure 2:
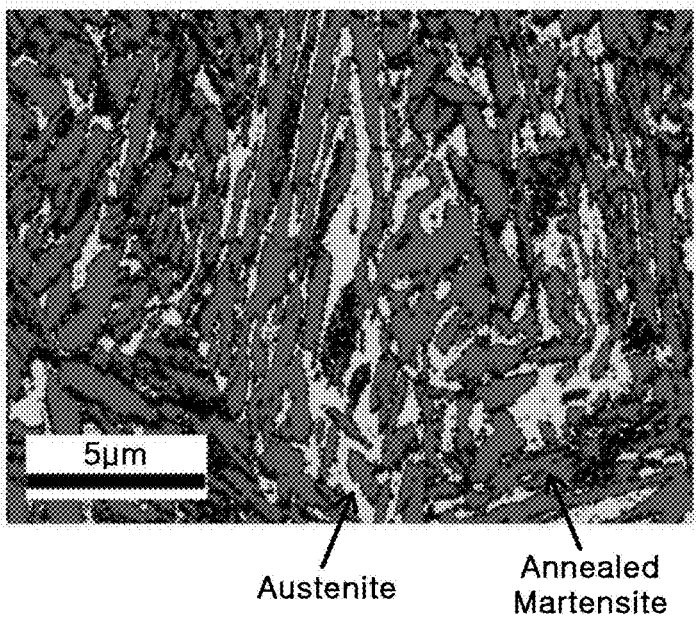

In FIG. 2, which is photographs of microstructures of a hot-rolled steel sheet of Inventive Example 12 having undergone a final annealing heat treatment, captured by (a) scanning electron microscopy (SEM) and (b) electron back-scatter diffraction (EBSD), it could be confirmed that grain sizes of retained austenite and annealed martensite, which are main phases, were fine, and an average ratio of the short axis to the long axis of a corresponding phase was found to be 0.5 or less. Further, superior yield strength and ratio, elongation ratio, and hole expansion ratio of the present Inventive Steel could be secured through the above structure composition and configuration control. In (b) of FIG. 2, dark grey indicates annealed martensite, and light grey indicates austenite.

Figure 3:
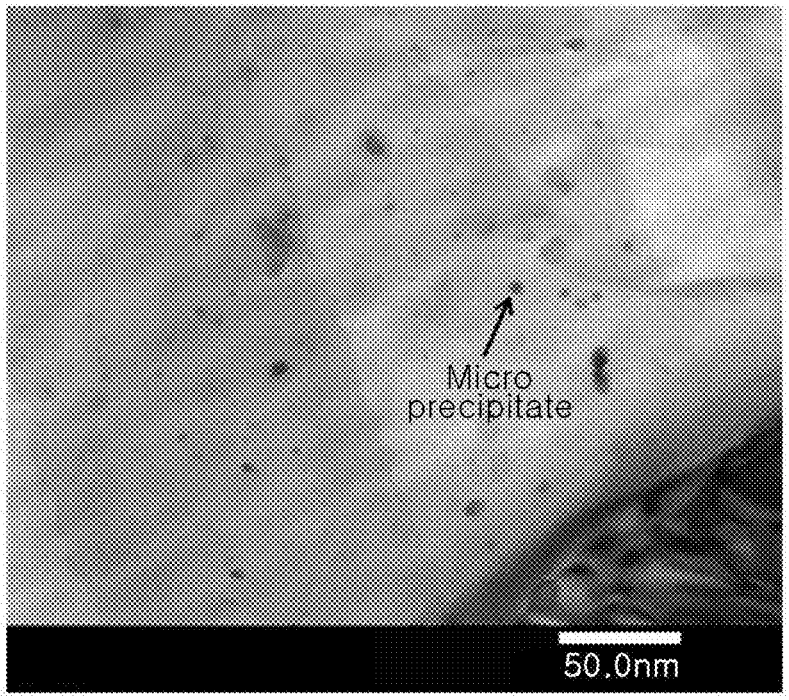
FIG. 3 is a photograph of the microstructure of a hot-rolled steel sheet of Inventive Example 12, having undergone a finish annealing heat treatment, the photograph captured by transmission electron microscopy (TEM).

Further, as can be seen in FIG. 3, a photograph of microstructures of a hot-rolled steel sheet of Inventive Example 12 having undergone a final annealing heat treatment, captured by transmission electron microscopy (TEM), micro precipitates were utilized for improving strength and hole expansion ratio, and precipitates having a size of 30 nm or less were included in an amount of 6*10 ^(14) ea./m^2.

However, if manufacturing conditions (an annealing heat treatment process) did not satisfy the present disclosure, it was difficult to secure desired mechanical properties even when the composition of the present disclosure was satisfied.

Among these cases, in an example that did not undergo a final annealing heat treatment (Comparative Example 1), examples where the annealing temperature was less than 590° C. (Comparative Examples 2, 3, 6, and 7), or an example where the annealing time was less than 40 seconds, the fraction of intercritical austenite decreased, and thus, it was difficult to secure percent elongation.

Also, in an example where an annealing temperature exceeded 690° C. (Comparative Example 5), the fraction of intercritical austenite drastically increased, and thus, yield strength and hole expansion ratio were unsatisfactory when the stability of retained austenite decreased.

As the result of analyses of microstructures of Comparative Example 4 and Comparative Example 5 by XRD, the fraction of retained austenite was 8% and 35% respectively, and it could be confirmed that to secure target tensile properties and hole expansion ratio of the present disclosure, the fraction of retained austenite should be controlled to 10-30%.

In addition, it could be confirmed that even when the manufacturing conditions proposed in the present disclosure were satisfied, if the alloy compositions proposed in the present disclosure were not satisfied, it is difficult to secure mechanical properties.

As seen in Comparative Examples 16-19, when Equation 1 was not satisfied due to insufficient additions of micro precipitating elements such as titanium (Ti), niobium (Nb), vanadium (V), and molybdenum (Mo), it could be confirmed that, since such micro precipitates contribute little to strength as described above, it was difficult to secure tensile strength and yield ratio.

Also, in the case of manganese (Mn) contents lower than 4.1% (Comparative Examples 20 and 21), it was difficult to secure tensile strength, whereas in the case of manganese (Mn) contents exceeding 9% (Comparative Examples 22-27), yield ratio was low.

While the present disclosure has been shown and described in connection with the exemplary embodiments, it will be apparent to those skilled in the art that modifications and variations can be made without departing the scope of the spirit and scope of the present disclosure as defined by the appended claims.

The invention claimed is:

1. A hot-rolled steel sheet comprising:

in terms of wt %: 0.05-0.2% of carbon (C); 2.0% or less of silicon (Si); 4.1-9.0% of manganese (Mn); 0.05% or less (excluding 0%) of phosphorus (P); 0.02% or less (excluding 0%) of sulfur (S); 0.5% or less (excluding 0%) of aluminum (Al); 0.02% or less (excluding 0%) of nitrogen (N); at least one selected among 0.1% or less (excluding 0%) of titanium (Ti), 0.1% or less (excluding 0%) of niobium (Nb), 0.2% or less (excluding 0%) of vanadium (V), and 0.5% or less (excluding 0%) of molybdenum (Mo); and a balance of iron (Fe) and other inevitable impurities, and satisfying the following Equation 1, Equation 1: $C/12+Ti/48+Nb/93+V/51+Mo/96 > 0.015$ where each element symbol represents a value of content of each element in wt %;

a microstructure including, in volume percentage, 10-30% of retained austenite, 50% or more of annealed martensite, and 20% or less of other phases including alpha martensite and epsilon martensite; and precipitates having a size of 30 nm or less in an amount of $10^{13}$ ea·/m$^2$, wherein the precipitates are carbides including at least one among titanium (Ti), niobium (Nb), vanadium (V) and molybdenum (Mo), nitrides including at least one among titanium (Ti), niobium (Nb), vanadium (V) and molybdenum (Mo), or complex carbonitrides including at least one among titanium (Ti), niobium (Nb), vanadium (V) and molybdenum (Mo), wherein the retained austenite and the annealed martensite have an acicular structure having a ratio of short axis to long axis of 0.5 or less.

2. The hot-rolled steel sheet of claim 1, further comprising: at least one selected among 1% or less (excluding 0%) of nickel (Ni), 0.5% or less (excluding 0%) of copper (Cu), 1% or less (excluding 0%) of chromium (Cr), and 0.01-0.1% of antimony (Sb).

3. The hot-rolled steel sheet of claim 1, further comprising: a hole expansion ratio of 15% or more, a yield ratio of 0.65 or more, and a tensile strength of 900 MPa or more, wherein a product of the tensile strength and the elongation ratio is 23,000 MPa % or more.

4. The hot-rolled steel sheet of claim 1, further comprising: a plating layer formed on a surface thereof.

5. The hot-rolled steel sheet of claim 1, further comprising: an alloyed plating layer formed on a surface thereof.

6. A hot-rolled steel sheet comprising:

in terms of wt %: 0.05-0.2% of carbon (C); 2.0% or less of silicon (Si); 4.1-9.0% of manganese (Mn); 0.05% or less (excluding 0%) of phosphorus (P); 0.02% or less (excluding 0%) of sulfur (S); 0.5% or less (excluding 0%) of aluminum (Al); 0.02% or less (excluding 0%) of nitrogen (N); at least one selected among 0.1% or less (excluding 0%) of titanium (Ti), 0.1% or less (excluding 0%) of niobium (Nb), 0.2% or less (excluding 0%) of vanadium (V), and 0.5% or less (excluding 0%) of molybdenum (Mo); and a balance of iron (Fe) and other inevitable impurities, and satisfying the following Equation 1, Equation 1: $C/12+Ti/48+Nb/93+V/51+Mo/96 > 0.015$ where each element symbol represents a value of content of each element in wt %;

a microstructure including, in volume percentage, 10-30% of retained austenite, 50% or more of annealed martensite, and 20% or less of other phases including alpha martensite and epsilon martensite;

precipitates having a size of 30 nm or less in an amount of $10^{13}$ ea·/m$^2$, wherein the precipitates are carbides including at least one among titanium (Ti), niobium (Nb), vanadium (V) and molybdenum (Mo), nitrides including at least one among titanium (Ti), niobium (Nb), vanadium (V) and molybdenum (Mo), or complex carbonitrides including at least one among titanium (Ti), niobium (Nb), vanadium (V) and molybdenum (Mo); and a hole expansion ratio of 15% or more, a yield ratio of 0.65 or more, and a tensile strength of 900 MPa or more, wherein a product of the tensile strength and the elongation ratio is 23,000 MPa % or more.

7. The hot-rolled steel sheet of claim 6, further comprising: at least one selected among 1% or less (excluding 0%) of nickel (Ni), 0.5% or less (excluding 0%) of copper (Cu), 1% or less (excluding 0%) of chromium (Cr), and 0.01-0.1% of antimony (Sb).

8. The hot-rolled steel sheet of claim 6, further comprising: a plating layer formed on a surface thereof.

9. The hot-rolled steel sheet of claim 6, further comprising: an alloyed plating layer formed on a surface thereof.

* * * * *